US006600887B2

(12) United States Patent
Takami et al.

(10) Patent No.: US 6,600,887 B2
(45) **Date of Patent: *Jul. 29, 2003**

(54) IMAGE FORMING APPARATUS FEATURING A SLIDE FRICTION SHEET FOR DISPERSING CONTAMINATION FROM A CHARGED ROTARY MEMBER

(75) Inventors: Norio Takami; Yasuyuki Ishii, both of Mishima; Kazunori Kobayashi, Susono, all of (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/261,952

(22) Filed: Mar. 3, 1999

(65) Prior Publication Data

US 2002/0090225 A1 Jul. 11, 2002

(30) Foreign Application Priority Data

Aug. 6, 1998 (JP) ..... 10-234942

(51) Int. Cl.[7] ..... G03G 15/02
(52) U.S. Cl. ..... 399/174; 399/176
(58) Field of Search ..... 15/1.51, 256.51, 15/256.52, 256.53; 399/71, 99, 100, 150, 168, 174, 176, 252

(56) References Cited

U.S. PATENT DOCUMENTS 5,455,661 A * 10/1995 Yoshida et al. ..... 399/100
5,799,229 A * 8/1998 Yokoyama et al. ..... 399/100

FOREIGN PATENT DOCUMENTS

| | | | |
|---|---|---|---|
| EP | 0 715 320 | * | 6/1996 |
| JP | 36-10231 | | 7/1961 |
| JP | 59-53856 | | 3/1984 |
| JP | 7-199604 | | 8/1995 |
| JP | 08-123154 | * | 5/1996 |
| JP | 8-328306 | | 12/1996 |
| JP | 9-244359 | | 9/1997 |
| JP | 9-325515 | | 12/1997 |
| JP | 10-48869 | | 2/1998 |
| JP | 10-186812 | | 7/1998 |

OTHER PUBLICATIONS

European Search Report dated Dec. 13, 1999.*

* cited by examiner

*Primary Examiner*—Hoang Ngo
(74) *Attorney, Agent, or Firm*—Fitzpatrick, Cella, Harper & Scinto

(57) ABSTRACT

An image forming apparatus includes an image bearing member, a charging rotary member rotating while contacting with the image bearing member, and a slide friction sheet contacting with the charging rotary member along an axial direction of the charging rotary member for dispersing contamination adhered to the charging rotary member.

23 Claims, 8 Drawing Sheets

IMAGE FORMING APPARATUS FEATURING A SLIDE FRICTION SHEET FOR DISPERSING CONTAMINATION FROM A CHARGED ROTARY MEMBER

BACKGROUND OF THE INVENTION

1. Field of the Invention

The present invention relates generally to an image forming apparatus such as a copying machine and a printer etc, and more particularly to an image forming apparatus using a charging rotary body coming into contact with an image bearing body.

2. Related Background Art

An image forming apparatus such as a copying machine or a printer etc. adopting an image forming method based on an electrophotographic system, has hitherto been constructed to form an image generally by a charging step of equally uniformly charging an image bearing body with electricity, a latent image forming step of writing an electrostatic latent image onto the image bearing body, a developing step of developing the electrostatic latent image with a toner, a transferring step of transferring the toner on the image bearing body onto a transfer material, a fixing step of fixing the toner on the transfer material, and a cleaning step of cleaning a residue such as transfer residual toner remaining on the image bearing body after the transfer ring step.

In the construction described above, a disposal-toner container contains the toner collected by the cleaning step, executed after the transferring step, of cleaning the residue on the photosensitive drum such as the transfer residual toner remaining on the image bearing body.

A charging unit for charging the image bearing body involves the use of a wide-spread contact charging system using a charging member brought into press-contact with the image bearing body.

The contact charging system has advantages such as saving the electric power and generating just a small amount of ozone.

What is predominant among the contact charging systems is a system using a charging roll in terms of a durability etc.

Further, there has been in recent years proposed a cleanerless process for actualizing an extremely efficient image forming apparatus by attaining an omission of collecting the on-the-photosensitive-drum residue such as the transfer residual toner in the cleaning step described above, a downsize of the image forming apparatus and an omission of the maintenance such as disposing of the toner and so forth.

In the cleanerless process, a developing device adheres the toner with a reversal developing to a portion where a surface potential is attenuated upon the photosensitive drum being exposed to the light, and collects the on-the-photosensitive-drum residue such as the transfer residual toner remaining on non-exposed portions.

More specifically, after the transferring step, the on-the-photosensitive-drum residue such as the transfer residual toner is, after passing through the charging step, collected by the developing device by power of static electricity due to a difference between the surface potential of the image bearing body and a developing bias (which is referred to as a back-contrast).

FIG. 8 shows an example of the apparatus using the cleanerless process.

Referring to FIG. 8, a charging roller 12 charges a photosensitive drum 1 classified as a rotary drum type electrophotographic photosensitive body serving as a charged body and an image bearing body as well.

Further, the charging system involves the use of a method of applying a DC voltage of −1300 V to a core bar of the charging roller 12 and charging the photosensitive drum 1 in contact with the drum 1, wherein a charging potential (a dark area potential) of the photosensitive drum 1 is set to −700 V.

Referring again to FIG. 8, a laser beam 9 is emitted from an unillustrated exposing unit on the photosensitive drum 1 to form thereon an electrostatic latent image of image information.

Subsequently, the latent image is developed with the toner by the developing roller 2 of the developing device. Simultaneously, in the present image forming apparatus incorporating no cleaning device, the developing roller 2 collects a residue 10 on the photosensitive drum 1 such as transfer residual toner remaining on the photosensitive drum 1.

The developed image is transferred onto a transfer material 5 led in between the photosensitive drum 1 and a transfer roller 4 at a proper timing from an unillustrated sheet supply unit.

A layer thickness regulating member 3 composed of a urethane rubber or a metal plate, of which a proximal end is fitted to a developer container, comes into elastic-contact with the developing roller 2, thus regulating a layer thickness of the toner on the surface of the developing roller 2 to a predetermined uniform value. An agitating member 7 provided in a toner hopper 6 serving as a container rotates, thereby supplying a predetermined quantity of toner to the developing roller 2.

The transfer material 5 passing through the transfer unit is separated from the photosensitive drum 1, then conveyed to an unillustrated image transfer unit, and repeatedly used for forming the image.

For collecting the residue 10 on the photosensitive drum 1 such as the transfer residual toner due to the back-contrast described above, it is required that the residue 10 on the photosensitive drum 1 such as the transfer residual toner charged to a positive polarity when in the transferring step, be charged to a negative polarity.

It proved from an experiment that according to the method of applying only the DC voltage to the core bar of the charging roller 12 and thus charging the surface of the photosensitive drum 1 while coming into contact with the photosensitive drum 1, the polarity of the residue 10 such as the transfer residual toner can be reversed from positive to negative to some extent during the charging step, however, a part of the residue 10 such as the transfer residual toner, which is insufficient in terms of reversion of its polarity, is nonuniformly adhered (as a contaminant 11 adhered onto the charging roller) to the surface layer of the charging roller 12. This conduces to a problem of causing a decline of charging uniformity.

As described above, the contact charging system has the problem that the charging member is contaminated and declines in terms of its charging uniformity. This problem is serious in the cleanerless process.

SUMMARY OF THE INVENTION

It is a primary object of the present invention to provide an image forming apparatus capable of preventing a charging member coming into contact with an image bearing body from being partially contaminated and effecting nonuniform charging.

It is another object of the present invention to provide an image forming apparatus capable of dispersing a contamination onto a charging rotary member by a slide friction sheet.

It is still another object of the present invention to provide an image forming apparatus capable of reciprocating the slide friction sheet.

Further objects of the present invention will be apparent in the following explanation.

DESCRIPTION OF THE PREFERRED EMBODIMENTS

Embodiments of the present invention will hereinafter be described with reference to the accompanying drawings.

Figure 1:
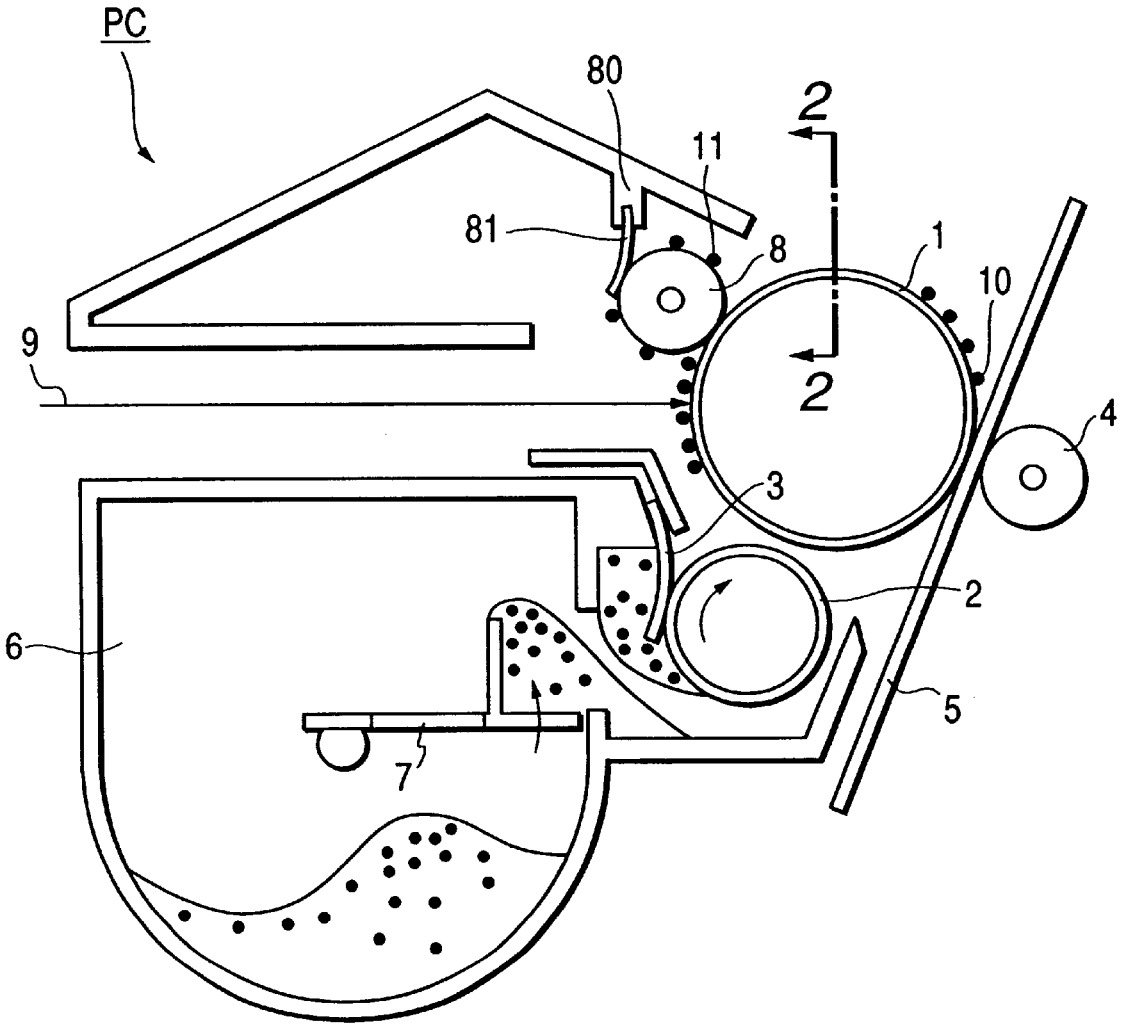
FIG. 1 is an explanatory sectional view showing a construction in a first embodiment.
Figure 2:
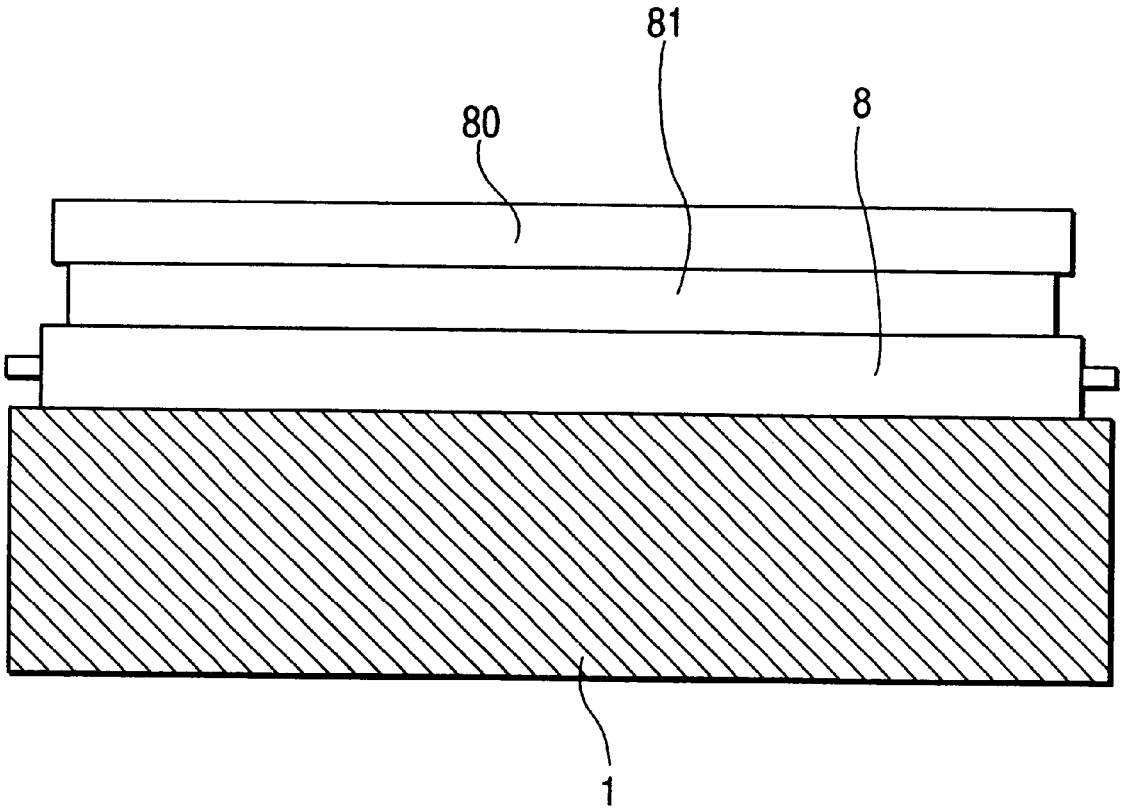
FIG. 2 is a view showing a portion vicinal to a slide friction member in the first embodiment.

FIG. 1 is a sectional view showing a principal portion of an image forming apparatus in an embodiment of the present invention. Note that the same members as those in the example shown in FIG. 8 are marked with the like numerals, of which an explanation is omitted.

The reference symbol PC designates a process cartridge defined as a unit attachable to and detachable from an apparatus body.

The process cartridge PC is constructed as an integral unit including the electrophotographic photosensitive drum 1 classified as the image bearing body, the charging unit having the charging roller 8, and the developing unit having the developing roller 2.

Figure 8:
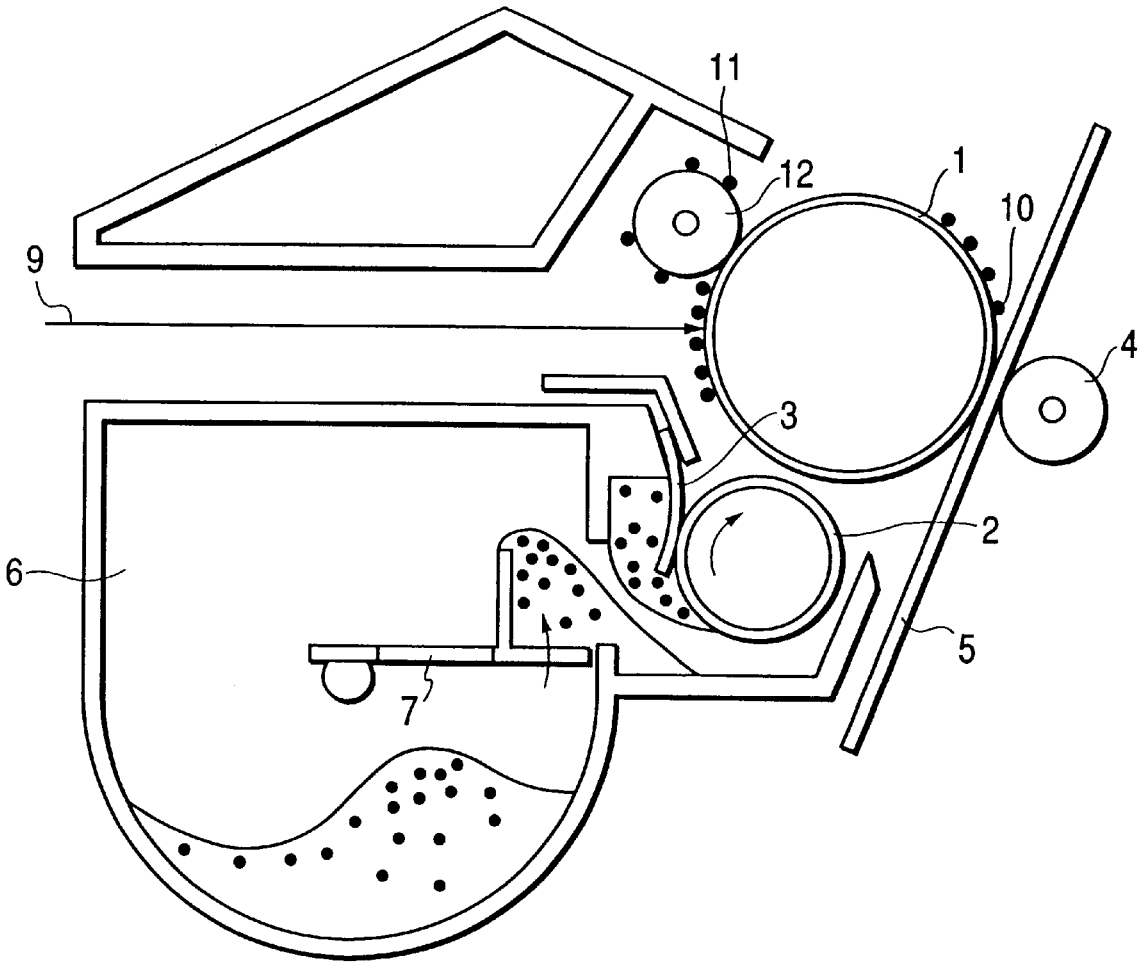
FIG. 8 is an explanatory sectional view showing one example of an image forming apparatus.

The image forming apparatus in the first embodiment adopts, as in the example shown in FIG. 8, the cleanerless process of executing again the uniform charging without cleaning the residual charging without cleaning the residual toner after transferring the toner image.

A developer in first embodiment is a nonmagnetic, one-component developer involving the use of a toner exhibiting advantages such as an excellent transferability and causing a less quantity of abrasion of the photosensitive drum 1 because of having a high lubricating property when the cleaning member such as a blade and a fur brush etc cleans the residual 10 off the photosensitive drum 1 like the transfer residual toner remaining on the photosensitive drum 1 without being transferred, i.e., the toner of which a configuration is spherical and a surface is smooth.

To be more specific, shape factors of the spherical toner used herein are given, wherein SF-1 is 100 to 180, and SF-2 is 100 to 140.

One hundred of toner images are sampled at random by use of FE-SEM (S-800) made by Hitachi Ltd., and pieces of image information thereof are inputted to and analyzed by an image analyzer (Luze×3) made by Nicolet Japan Corporation through an interface. Then, Sf-1 and SF-2 are defined by values calculated in the formulae which follow:

$$SF\text{-}1=(M\times LNG)^2/\mathrm{AREA}\times\pi/4\times 100$$

$$SF\text{-}2=(PERI)^2/\mathrm{AREA}\times\pi/4\times 100$$

where AREA is the toner projection area, M×LNG is the absolute maximum length, and PERI is the peripheral length.

The toner shape factor SF-1 indicates a degree of spherical shape, in which as the value becomes larger than 100, the shape becomes more undefined gradually from the sphere. SF-2 indicates a degree of ruggedness, wherein as the value becomes larger than 100, the ruggedness on the toner surface becomes more conspicuous.

A method capable of manufacturing the toner may include, in addition to the manufacturing method based on a so-called pulverizing method, if within the above range of the shape factor, a method of directly generating the toner by use of a suspension polymerization method disclosed in Japanese Patent Application Laid-Open Nos. 36-10231 and 59-53856, a dispersion polymerization method of directly generating the toner by using an aqueous organic solvent in which a polymer obtained as being soluble in a monomer is insoluble, and an emulsion polymerization method represented by a soap-free polymerization method of generating the toner by direct polymerization under an existence of a water soluble polarity polymerization initiator.

In accordance with first embodiment, colored suspension particles having a weight average particle diameter of 7 $\mu$m are manufactured by use of the suspension polymerization method under a normal pressure or under pressurization in which the toner shape factor SF-1 can be easily controlled to 100 to 180, and SF-2 to 100 to 140, and a particulate toner exhibiting a sharp particle size distribution and having a particle diameter of 4 to 8 $\mu$m is comparatively easily obtained, wherein styrene and n-butyl acrylate are used as monomers, a metal compound salicylate is used as a charge control agent, saturated polyester is used as a polarity resin, and a coloring agent is added.

Then, hydrophobic silica of 1.5 wt % is added, thus manufacturing the negative polar toner exhibiting the excel transferability and a small quantity of abrasion when cleaning the photosensitive drum 1 as described above.

Note that the (magnetic/non-magnetic) pulverized toner can be used as a developer in first embodiment. The rotary drum-type electrophotographic photosensitive body (the photosensitive drum 1) is used as the charged body (the image bearing body).

The charging roller 8 including the elastic material layer is used as the charging device. The charging system involves the use of the method of charging the photosensitive drum 1 while coming into contact therewith by applying the DC voltage of −1300 V to the core bar of the charging roller 8, wherein the charging potential (the dark area potential) of the photosensitive drum 1 is set to −700 V.

Further, a sheet-like slide-friction member 81 disposed in close proximity to the charging roller 8 is used as the device for uniformly dispersing by slide friction the residue 10 on the photosensitive drum 1 such as the transfer residual toner, etc. adhered ununiformly to the surface layer of the charging roller 8. The slide friction member 81 is fixed directly to a support member 80 provided on a box body of the process cartridge PC.

This slide friction sheet 81 is composed of a resinous film of which a main component is polyimide having a thickness of 50 $\mu$m.

Then, the slide friction sheet 81 exclusive of its edges comes into contact with the charging roller 8, wherein a nip having a width of approximately 0.5 mm is formed.

Figure 3:
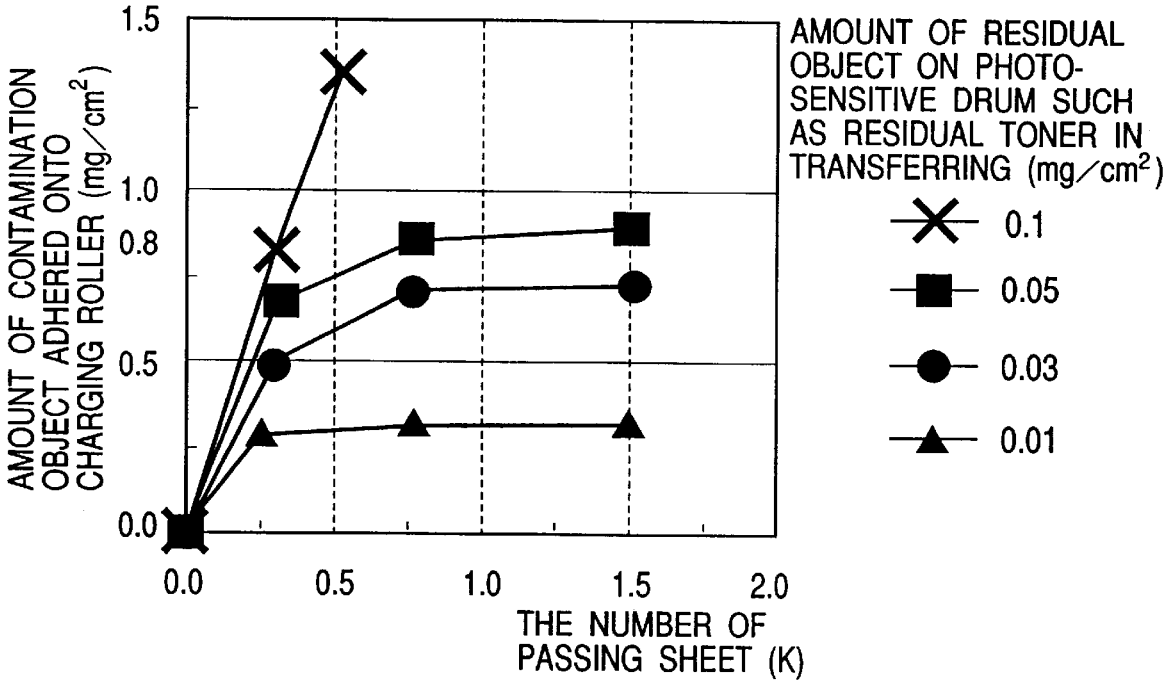
FIG. 3 is a graphic chart showing a relationship between the number of passing sheets and a quantity of contaminant adhered onto a charging roller.

According to the experiment, as shown in a graphic chart in FIG. 3, in the case of using the method of charging the photosensitive drum 1 while coming into contact with the drum 1 by applying the DC voltage to the core bar o the charging roller 8, if a density of the on-the-photosensitive-drum residue 10 such as the transfer residual toner, for one periphery of the photosensitive drum 1, is 0.05 (mg/cm$^2$) or under, a density (mg/cm$^2$) of the adhered-to-the-charging roller contaminant 11 adhered to the surface layer of the charging roller 8 is saturated. Referring again to FIG. 3, the axis of the abscissas indicates the number of sheets passing through, and the axis of ordinates indicates the quantity of contaminant adhered to the charging roller.

Referring back to FIG. 1, a laser beam 9 defined as an exposure light beam emitted by an unillustrated exposure device impinges upon the photosensitive drum 1 to form thereon an electrostatic latent image of image information. An electric potential (a bright area potential) of the surface of the photosensitive drum 1 at the exposure portion is set to −120 V.

Subsequently, this latent image is developed (at a developing bias is −350 V) with the toner by the developing roller 2 of the developing device disposed coming into contact with or in close proximity to the photosensitive drum 1. The developed image is led to a transferring unit between the photosensitive drum 1 and the transferring roller 4 at a proper timing from an unillustrated sheet supply unit, and is transferred onto the transfer material 5.

The transfer material 5 passing through the transferring unit is separated from the photosensitive drum 1 and conveyed to an unillustrated image fixing unit.

The on-the-photosensitive-drum residue 10 such as the transfer residual toner etc is nonuniformly adhered to the surface layer of the charging roller 8 in accordance with an image pattern, etc, thus turning out to be the contaminant 11 adhered to the charging roller. The contaminant 11 adhered to the charging roller is, however, uniformly dispersed by the sheet-like slide friction member disposed in the close proximity to the charging roller 8, and adhered uniformly in the peripheral direction to the surface layer of the charging roller 8.

Figure 4A:
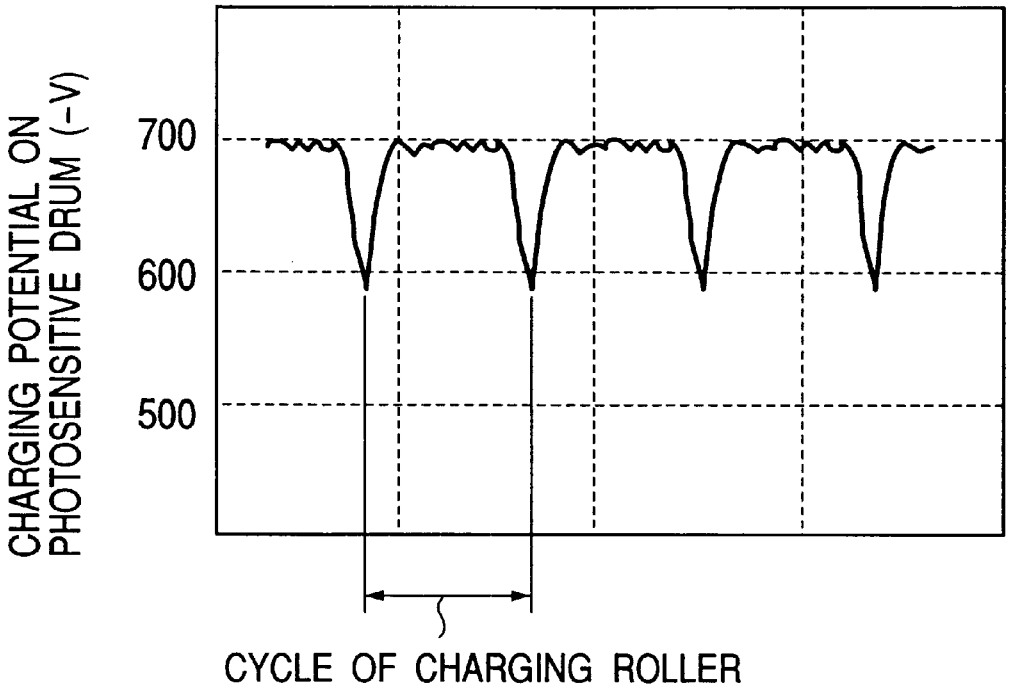
FIGS. 4A and 4B are graphic charts showing a profile of a charging potential in the first embodiment.
Figure 4B:
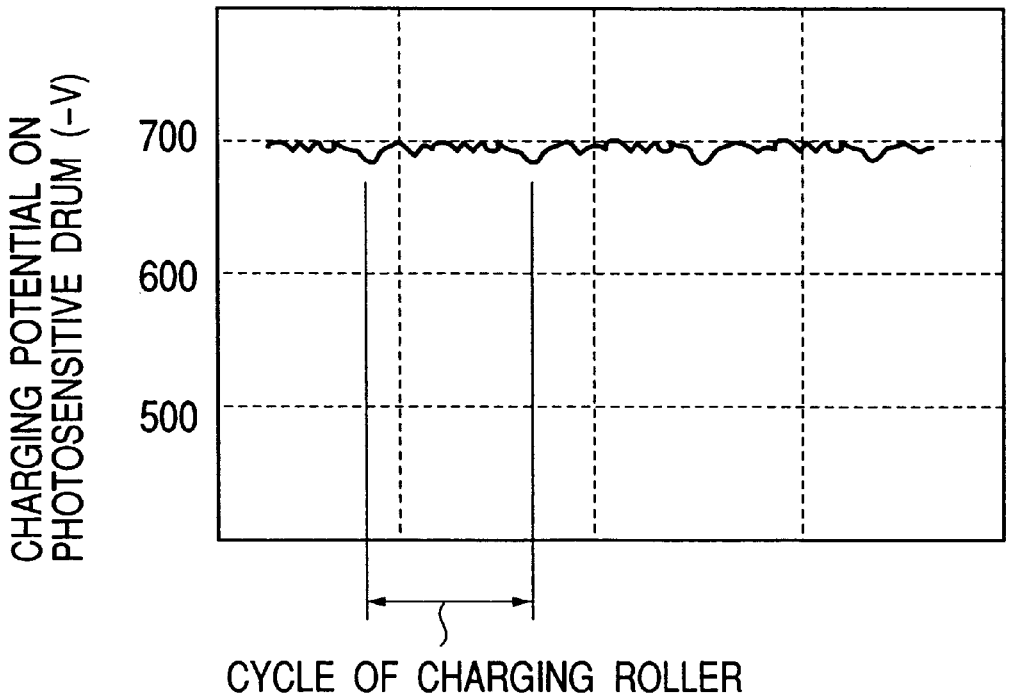

As a result, a charging uniformity in the peripheral direction on the surface of the photosensitive drum 1 is enhanced as shown in graphic charts in FIGS. 4A and 4B. FIG. 4A is a graphic chart showing a state of the charging potential on the photosensitive drum, corresponding to a cycle of the charging roller in the reference example shown in FIG. 8. FIG. 4B is a graphic chart showing a state of the charging potential on the photosensitive drum, corresponding to a cycle of the charging roller in the first embodiment.

Further, a spot diameter of the laser beam 9 which actualizes 600 dpi is 75 to 90 $\mu$m. It proved from an experiment that there is no image disorder due to a light interception if a quantity of the on-the-photosensitive-drum residue 10 such as the transfer toner, etc. for one periphery of the photosensitive drum 1 is under 0.1 (mg/cm$^2$).

After the exposure, the on-the-photosensitive-drum residue 10 such as the transfer residual toner with the negative polarity, is electrically adhered to the developing roller 2 by a back contrast (350 V), and collected into the developing device. There is reused the on-the-photosensitive-drum-1 residue 10 such as the transfer residual toner etc which has been collected by the developing roller 2.

As discussed above, in the first embodiment, the contaminant 11 adhered to the charging roller, into which the transfer residual toner adhered nonuniformly in the peripheral direction to the charging roller 8 has changed, is dispersed by the slide friction against the simply constructed slide friction member 81, whereby it is feasible to obtain the uniform charging potential of the charging roller 8 and to uniformly charge the photosensitive drum 1.

Further, the slide friction sheet 81 in the first embodiment is structured so that the sheet surface, particularly the surface excluding its edges, comes into surface contact with the charging roller 8.

Hence, there is no step of cleaning the contaminations by the toner and sheet powdery matters on the charging roller 8.

When cleaning the surface of the charging roller 8, there must be a large attacking force upon the charging roller, however, an influence on the charging roller is small and a durable life-span of the charging roller is long in the first embodiment.

(Second Embodiment)

A second embodiment of the present invention will hereinafter be discussed with reference to the accompanying drawings.

Figure 5:
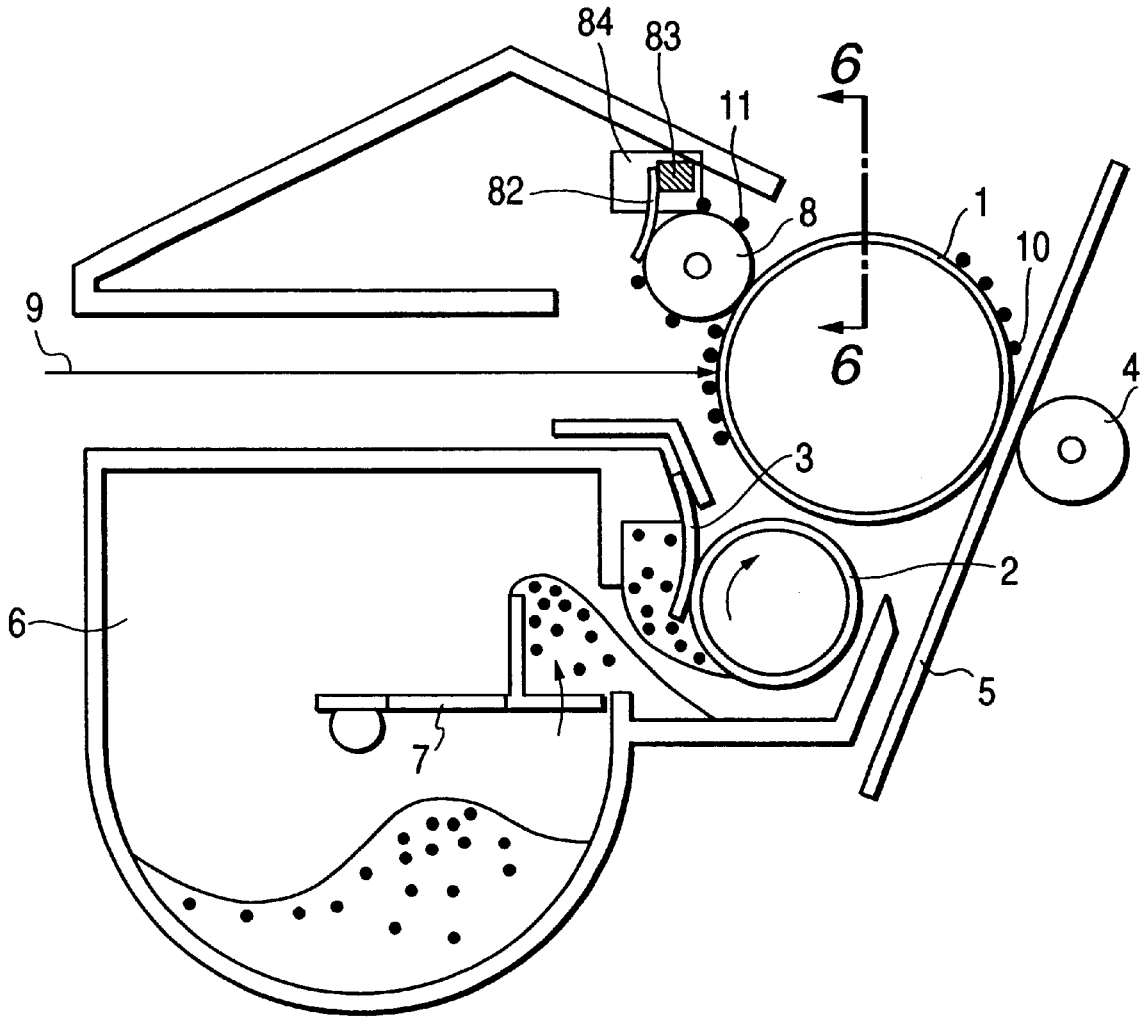
FIG. 5 is an explanatory sectional view showing a construction in a second embodiment.
Figure 6:
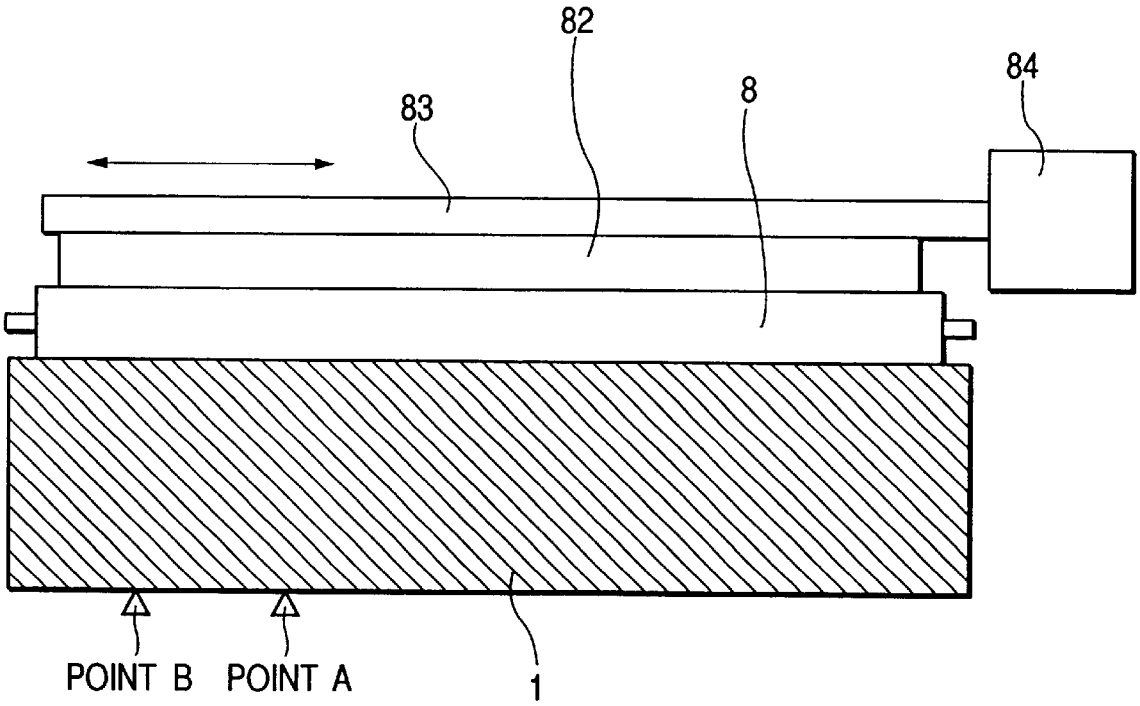
FIG. 6 is a view showing a portion vicinal to the slide friction member in a second embodiment.

FIG. 5 is an explanatory sectional view showing a construction of a principal portion of the image forming apparatus to which the present invention is applied. FIG. 6 is a view showing a portion vicinal to a slide friction member 82 as viewed in the direction 6—6 in FIG. 5.

The developer used in the second embodiment is, as in the first embodiment, a nonmagnetic, one component developer, of which the spherical toner shape factor SF-1 is 100 to 180 and SF-2 is 100 to 140.

Further, the same components as those in the first embodiment are marked with the like numerals, the explanation of which is omitted. The photosensitive drum 1, the developing roller 2 and the charging roller 8 have the same constructions.

In the second embodiment, however, a moving mechanism for moving the slide friction member in reciprocation with respect to the charging roller 8 in parallel to the axial direction of the photosensitive drum 1, includes a drive member 84 and a drive support member 83 reciprocated in an arrow direction in FIG. 6 by the drive member 84, herein the slide friction member 82 is supported by the drive support member 83.

The residue 10 on the photosensitive drum 1 such as the transfer residual toner etc is nonuniformly adhered to the surface layer of the charging roller 8 in accordance with an image pattern etc, thus turning out to be the contaminant 11 adhered to the charging roller. The adhered-to-the-charging-roller contaminant 11 is, however, uniformly dispersed by the sheet-like slide friction member 82 disposed in close proximity to the charging roller 8 and reciprocated in the axial direction of the photosensitive drum 1, and adhered uniformly in the peripheral and longitudinal directions to the surface layer of the charging roller 8.

Figure 7A:
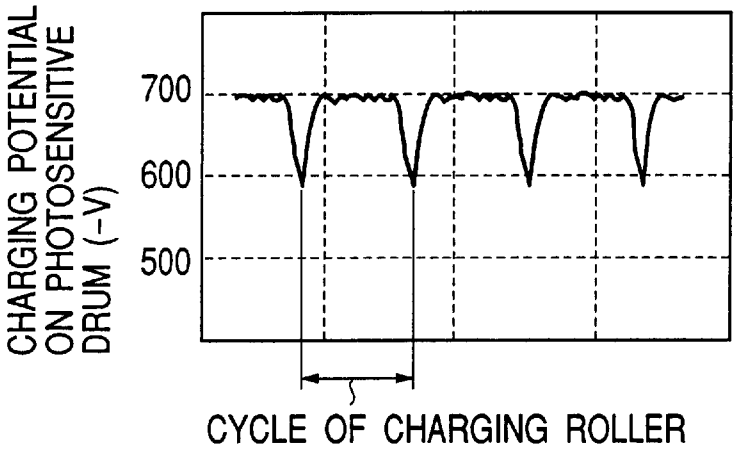
FIGS. 7A, 7B, 7C and 7D are graphic charts showing a profile of the charging potential in the second embodiment.
Figure 7B:
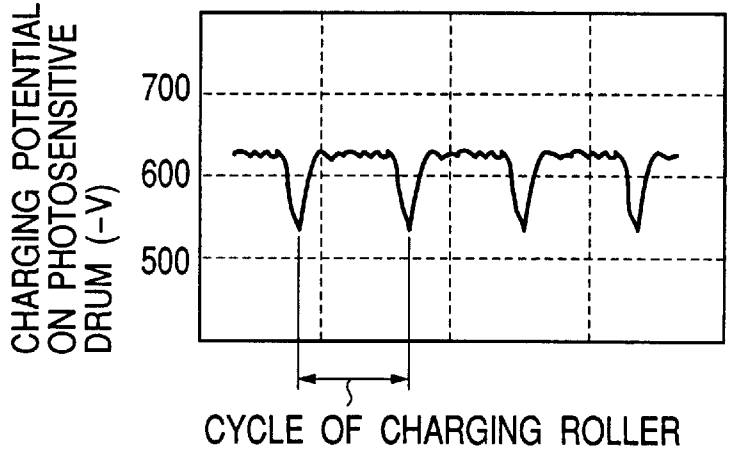
Figure 7C:
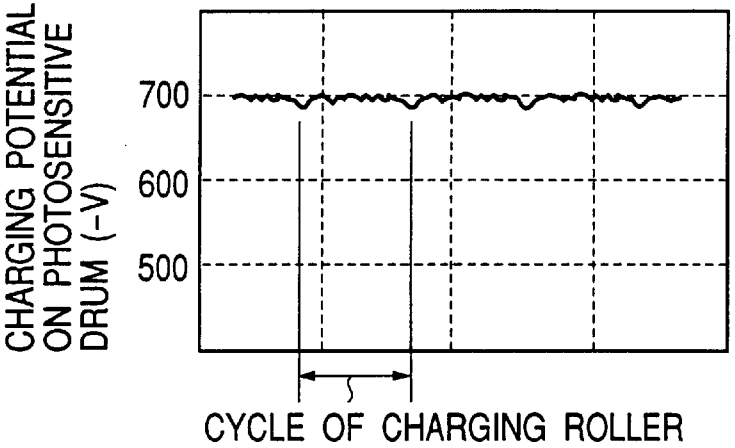
Figure 7D:
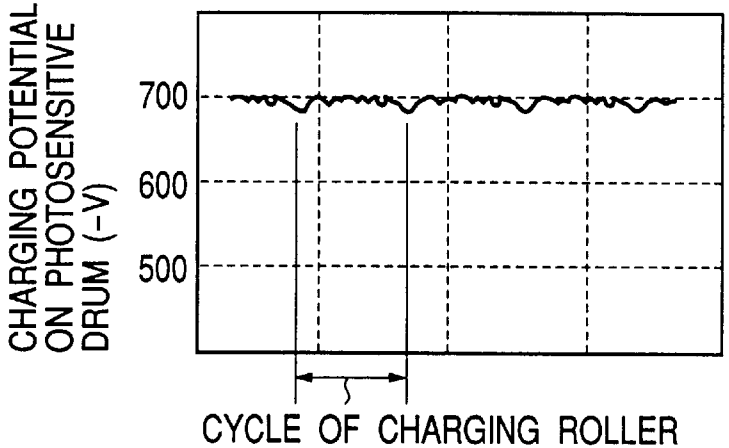

As a result, the charging uniformity in the peripheral and longitudinal directions on the surface of the photosensitive drum 1 is enhanced as shown in FIGS. 7A to 7D. FIGS. 7A and 7B show charging potentials at points A and B spaced away in the axial direction of the photosensitive drum 1 in FIG. 8. FIGS. 7C and 7D show charging potentials at the points A and B (see FIG. 6) spaced away in the axial direction of the photosensitive drum 1 in the second embodiment.

As described above, in the second embodiment, the contaminant 11 adhered to the charging roller, into which the transfer residual toner adhered ununiformly in the axial direction as well as in the peripheral direction to the charging roller 8 has changed, is dispersed more effectively by the slide friction against the simply constructed moving slide friction member 82, whereby it is feasible to obtain the uniform charging potential.

As discussed above, according to the present invention, a long-term durability can be attained because of giving no large attacking force to the charging roller, and it is possible to prevent the charging potential from being ununiform due to a partially contaminated surface of the charging roller.

What is claimed is:

1. An image forming apparatus comprising:

an image bearing member for bearing a toner image;

a charging rotary member, which rotates while contacting with said image bearing member;

developing means for developing an electrostatic image formed on said image bearing member with toner, wherein said developing means is capable of collecting a residual toner on said image bearing member while effecting a developing operation; and a slide contact sheet contacting with said charging rotary member along an axial direction of said charging rotary member for dispersing contaminants adhered to said charging rotary member, wherein said slide contact sheet is a film and said slide contact sheet electrically floats.

2. An image forming apparatus according to claim 1, wherein a portion of said slide contact sheet, exclusive of edges of said slide contact sheet, contacts with said charging rotary member.

3. An image forming apparatus according to claim 1, wherein said charging rotary member is in the form of a roll-like configuration.

4. An image forming apparatus according to claim 1, further comprising reciprocating means for reciprocating said slide contact sheet in the axial direction.

5. An image forming apparatus according to claim 1, wherein a shape factor SF-1 of the toner is in the range of 100 to 180, and a shape factor SF-2 of the toner is in the range of 100 to 140.

6. An image forming apparatus according to claim 1, wherein said image bearing member includes a photosensitive member, and said charging rotary member substantially uniformly charges said image bearing member.

7. An image forming apparatus according to claim 6, wherein said image bearing member and said charging rotary member are constructed as a unit, which is attachable to and detachable from a main body of said image forming apparatus.

8. An image forming apparatus according to claim 6, further comprising:

exposing means for forming the electrostatic image by image-exposing said image bearing member charged by said charging rotary member; and transferring means for transferring a toner image on said image bearing member onto a transfer material.

9. An image forming apparatus according to claim 8, wherein after the toner image has been transferred by said transferring means, said image bearing member is charged by said charging rotary member without the residual toner thereon being collected.

10. An image forming apparatus according to claim 1, wherein the contaminants contain the toner.

11. An image forming apparatus according to claim 1, wherein said film is a resin film.

12. An image forming apparatus according to claim 1, wherein said slide contact sheet contacts with said charging rotary member while said image bearing member is charged by said charging rotary member.

13. A process cartridge detachably mountable on a main body of an image forming apparatus, said process cartridge comprising:

an image bearing member for bearing a toner image;

a charging rotary member, which rotates while contacting with said image bearing member; and a slide contact sheet contacting with said charging rotary member along an axial direction of said charging rotary member for dispersing contaminants adhered to said charging rotary member, wherein said slide contact sheet is a film and said slide contact sheet electrically floats.

14. A process cartridge according to claim 13, wherein when said process cartridge is mounted on the main body, and an electrostatic image formed on said image bearing member is capable of being developed with toner by developing means, and wherein said developing means is capable of collecting a residual toner on said image bearing member while effecting a developing operation.

15. A process cartridge according to claim 14, wherein said developing means is provided in said process cartridge.

16. A process cartridge according to claim 13, wherein a portion of said slide contact sheet, exclusive of edges of said slide contamination sheet, contacts with said charging rotary member.

17. A process cartridge according to claim 13, wherein said charging rotary member is in the form of a roll-like configuration.

18. A process cartridge according to claim 13, further comprising reciprocating means for reciprocating said slide contact sheet in the axial direction.

19. A process cartridge according to claim 13, wherein when said process cartridge is mounted on the main body, and an electrostatic image formed on said image bearing member is capable of being developed with toner by developing means, and wherein a shape factor SF-1 of the toner is in the range of 100 to 180, and a shape factor SF-2 of the toner is in the range of 100 to 140.

20. A process cartridge according to claim 13, wherein said image bearing member includes a photosensitive member, and said charging rotary member substantially uniformly charges said image bearing member.

21. A process cartridge according to claim 19, wherein the contaminants contain the toner.

22. A process cartridge according to claim 13, wherein said film is a resin film.

23. A process cartridge according to claim 13, wherein said slide contact sheet contacts with said charging rotary member while said image bearing member is charged by said charging rotary member.

* * * * *

UNITED STATES PATENT AND TRADEMARK OFFICE

CERTIFICATE OF CORRECTION

PATENT NO. : 6,600,887 B2
DATED : July 29, 2003
INVENTOR(S) : Norio Takami et al.

It is certified that error appears in the above-identified patent and that said Letters Patent is hereby corrected as shown below:

Column 1,
Line 27, “transfer ring” should read -- transferring --; and
Line 34, “wide-spread” should read -- widespread --.

Column 2,
Line 43, “proved” should read -- was proved --.

Column 3,
Line 60, “residual 10” should read -- residue 10 --.

Column 4,
Line 5, “Sf-1” should read -- SF-1 --.

Column 5,
Line 10, “o” should read -- of --;
Line 28, “is” should read -- of --; and
Line 58, “proved” should read -- was proved --.

Column 7,
Line 3, “ununiformly” should read -- nonuniformly --;
Line 12, “ununiform” should read -- nonuniform --; and
Line 59, “image” should read -- image borne --.

Column 8,
Line 26, “and” should be deleted; and
Line 45, “and” should be deleted.

Signed and Sealed this

Thirteenth Day of January, 2004

JON W. DUDAS
*Acting Director of the United States Patent and Trademark Office*